US006220070B1

(12) United States Patent
Drigani et al.

(10) Patent No.: US 6,220,070 B1
(45) Date of Patent: Apr. 24, 2001

(54) SHEARING AND COILING ASSEMBLY FOR HOT ROLLED STOCK

(75) Inventors: Fausto Drigani, Pozzuolo del Friuli; Giacinto Dal Pan, Cellatica; Cesare Galletti, Segrate S. Felice, all of (IT)

(73) Assignee: Danieli & C. Officine Meccaniche, Buttrio (IT)

( * ) Notice: Subject to any disclaimer, the term of this patent is extended or adjusted under 35 U.S.C. 154(b) by 0 days.

(21) Appl. No.: 09/462,685

(22) PCT Filed: Jul. 14, 1998

(86) PCT No.: PCT/IB98/01068

§ 371 Date: Mar. 27, 2000

§ 102(e) Date: Mar. 27, 2000

(87) PCT Pub. No.: WO99/03614

PCT Pub. Date: Jan. 28, 1999

(30) Foreign Application Priority Data

Jul. 15, 1997 (IT) ..... UD97A0124
Nov. 6, 1997 (IT) ..... UD97A0199

(51) Int. Cl.[7] ..... B21B 1/00; B21B 41/00
(52) U.S. Cl. ..... 72/203; 72/227
(58) Field of Search ..... 72/203, 227, 205, 72/234, 226, 200, 202, 204, 250, 251

(56) References Cited

U.S. PATENT DOCUMENTS 2,699,904 * 1/1955 Wood ..... 72/203
4,432,221 * 2/1984 Barten .
4,761,983 * 8/1988 Ginzburg et al. .
5,285,670 * 2/1994 Thomas ..... 72/203

FOREIGN PATENT DOCUMENTS

0972603 * 9/1959 (DE) .

OTHER PUBLICATIONS

Patent Abstracts of Japan, vol. 014, No. 517, Nov. 13, 1990 & JP 02217113, Aug. 29, 1990.*
Patent Abstracts of Japan, vol. 017, No. 449, Aug. 18, 1993 & JP 05104138, Apr. 27, 1993.*
Patent Abstracts of Japan, vol. 011, No. 010, Jan. 10, 1987 & JP 61186152, Aug. 19, 1986.*
Patent Abstracts of Japan, vol. 095, No. 007, Aug. 31, 1995 & JP 07100533, Apr. 18, 1995.*
Patent Abstracts of Japan, vol. 013, No. 170, Apr. 21, 1989 & JP 01005625, Jan. 10, 1989.*

* cited by examiner

*Primary Examiner*—Rodney A. Butler
(74) *Attorney, Agent, or Firm*—Stevens, Davis, Miller & Mosher, LLP

(57) ABSTRACT

A shearing and coiling assembly for hot rolled stock with a thickness of between 0.5 and more than 5 mm, comprising a shearing unit (11) and a coiling machine (10) comprising a turntable assembly (12) rotating around an axis of rotation (13) orthogonal to the axis of feed of the rolled stock and lying on a plane substantially parallel to the plane of feed (14) of the rolled stock. The turntable assembly (12) supports two coiling mandrels (15*a*, 15*b*) arranged diametrically opposite each other and with an axis parallel to the axis of rotation (13). The turntable assembly (12) includes at least a first operating position wherein the first mandrel (15*a*) is in a position awaiting the leading end of the rolled stock and ready to begin coiling, substantially cooperating with the plane of feed (14) and at least a second operating position, rotated by 180° with respect to the first operating position, wherein the first mandrel (15*a*) is in a position where the rolled stock is completely coiled and the coil (30) is ready to be discharged and the second mandrel (15*b*) is in a position awaiting the leading end of the rolled stock and ready to begin coiling. The shearing unit (11) can be moved between a working position in which it is aligned with the plane of feed (14) of the rolled stock, and an inactive position distant from the plane of feed (14).

24 Claims, 6 Drawing Sheets

SHEARING AND COILING ASSEMBLY FOR HOT ROLLED STOCK

FIELD OF THE INVENTION

This invention concerns a shearing and coiling assembly for hot-rolled stock, such as strip or sheet, as set forth in the main claim.

The invention is applied in rolling lines for flat products to optimise, rationalise and accelerate the steps of forming the hot rolled coils performed downstream of the rolling train.

The invention is applied specifically with regard to the production of strip or sheet both with a thickness of between 0.5 and 5 mm, and also of more than 5 mm, with the temperature of the rolled stock at about 700–800° C. or more and with a production of around 20–22 metres per second.

BACKGROUND OF THE INVENTION

In the state of the art, there are a plurality of devices and apparatus to coil strip or sheet leaving the hot or cold rolling train, which perform their function more or less efficiently.

One type of coiling machine particularly used in the hot rolling of strip or sheet is the downcoiler, which includes at least two coiling mandrels arranged in sequence and below the plane on which the strip or sheet which has to be coiled passes.

This coiling system, although it is widely used, has problems both regarding the speed at which the coils are formed and also regarding the quality of the sheet obtained, especially in the case of products which are particularly thin.

In fact, in the case of thin strip or sheet, when the leading end is bent under the plane on which it is fed in order to be coiled onto the downcoiler, there may be problems caused in the quality of the product.

Moreover, coiling is not carried out in a repetitive manner since it is performed alternately on two downcoilers placed at different distances from the shears.

Another problem which is also linked to the thinness of the strip or sheet to be coiled is that the strip rubs against the runway which delivers it to the coiling machine, which can cause a deterioration in the surface quality of the strip or sheet.

Another problem is that with the systems known in the state of the art with a guide belt for initial winding, the winding speeds must necessarily remain low. A further problem is the lead-in of the strip during the initial winding step when thin strip is being produced.

A further disadvantage is the distance between the shears and downcoiler downstream due to the consequent dangers of blockages of the leading end of the rolled stock, and the problems of losing temperature due to radiance.

There is also the problem of the trailing end of the wound strip which knocks against the equipment during the braking step of the coil. It is also a problem to support the coiling mandrel as a cantilever.

A further problem is how to guide the strip without causing damage to the surface thereof.

The present applicants have designed, tested and embodied this invention to overcome the shortcomings of the state of the art by providing a functional and extremely efficient solution both operationally and in terms of the quality of the product.

SUMMARY OF THE INVENTION

The invention is set forth and characterised in the main claim, while the dependent claims describe variants of the idea of the main embodiment.

The purpose of the invention is to provide a shearing and coiling assembly wherein, when working rolled stock of relatively thin thickness of between 0.5 and 5 mm, the rolled stock can be coiled, whereas the coiling action can be avoided when working rolled stock with a thickness of more then 5 mm.

Another purpose of the invention is to achieve a shearing and coiling assembly which provides a shearing unit which can easily and selectively be associated with the rolling line, to shear to size the rolled stock when it has a defined thickness, less than 5 mm, and which can also be removed from the rolling line when the rolled stock is more than 5 mm thick.

A third purpose is to provide a coiling device for thin strip or sheet suitable to solve efficiently the above-mentioned shortcomings and in particular to guarantee efficiency, functionality and rationality to the coiling operations.

A further purpose is to obtain coiling conditions which will limit as much as possible any alterations to the characteristics of surface quality of the rolled stock to be coiled.

The shearing and coiling assembly according to the invention is mounted at the outlet of a finishing train for strip or sheet of a thickness which can be between 0.5 and 5 mm or above 5 mm and travelling at a speed of around 20–22 metres per second.

According to the invention, the coiling machine is located immediately downstream of a shears assembly which acts when the coiling of a coil is complete, and to prepare the leading end of the strip which will form the following coil.

The shears assembly, according to the invention, is arranged as near as possible to the coiling machine so as to reduce to a minimum the risks of blockages of the leading end of the strip.

In accordance with these purposes, the coiling machine comprises a retractable rollerway which intervenes when products of a greater thickness are to be worked; these cannot be coiled by the coiling machine according to the invention and are therefore translated downstream after the coiling machine has been excluded from the line or, in any case, has assumed a non-operative condition.

According to a variant of the invention, the shears includes a positioning and holding frame which is associated with a movable capsule which carries the shearing blades and facilitates their replacement.

According to a variant, the capsule can be extracted/inserted axially to the axis of the blades.

According to the invention, the coiling machine consists of a turntable assembly on which two coiling mandrels are mounted at a diametrically opposed position.

The turntable assembly may rotate to assume at least three positions, respectively a position of exclusion and two operating positions.

In the first position of exclusion, the two mandrels are both in a position of non-contact with the plane of feed of the rolled stock.

This position is assumed when rolled stock of great thickness is being produced, as the rollerway is placed in the operating position to deliver the rolled stock to conventional coiling machines, for example, downcoilers, or to cooling devices.

In the first operating position, a first mandrel is in a position where it substantially cooperates with the plane of feed of the rolled stock, and is waiting to receive the leading end of the rolled stock to be coiled, while a second mandrel is in a position which respectively may be to discharge the completed coil or end of coiling.

In this first operating position, the coiling of the strip is begun and carried out on the first mandrel, for a certain desired length.

In the second operating position, rotated substantially by 180° with respect to the first operating position, the first mandrel moves to a position wherein coiling is completed, while the second mandrel is taken to a waiting position cooperating with the plane of feed of the rolled stock so as to form a second coil.

Therefore, the coiling method includes a repeated sequence of alternate coiling on one mandrel and the other, as the completed coil is discharged with means known to the state of the art from the mandrel before the same mandrel returns to the start-of-coiling position.

According to the invention, the shearing and coiling assembly comprises at least a movable guide blade hinged on to the shearing unit and arranged above the plane of feed of the rolled stock.

According to a variant, there are two movable guide blades, one below and one above the plane of feed of the rolled stock.

According to a variant, the upper movable guide blade is associated with a second movable guide blade, rotatable on the first and carrying at least a sliding roller in the free head.

The movable guide blades have an operating position wherein they support and guide the rolled stock cooperating with the plane of feed of the rolled stock and a position wherein they are substantially excluded from the plane of feed so as not to create interference.

The upper guide blade, moreover, includes a third position which it assumes during the cycle and in the transition phase between the two positions; in this position the upper guide blade grips the rolled stock as it is being coiled onto the mandrel located in its second position, and accompanies the rolled stock on its plane of feed so as to prepare it to be picked up by the other mandrel located in the first operating position.

According to the invention, the movable guide blades include slits on their surfaces which cooperate with the plane of feed of the rolled stock; the slits emit jets of air, liquid or a mixture thereof to support the rolled stock which is to be sent for coiling.

The pneumatic, hydraulic or mixed support prevents problems caused by friction on the surface of the rolled stock, which are considerable in the case of thin stock as in the invention and therefore it prevents a deterioration of the surface quality of the finished product.

Moreover, this support prevents the leading end of the rolled stock from overturning or bending, in the segment between the drawing assemblies-shears and the mandrel, and thus prevents risks of blockages or impact with the equipment.

According to a variant, in cooperation with the jets of air there are driven rollers travelling at a speed greater than that of the strip and which have the effect of thrusting the strip itself, thus preventing blockages.

According to the invention, the mandrel located in the first operating position, wherein coiling is started and which cooperates with the plane of feed of the rolled stock, cooperates with an assembly of wrapper rollers mounted on articulated arms which come into outer contact with the rolled stock to be coiled, at several circumferential positions, thus facilitating and accelerating coiling.

According to a variant, the leading end of the strip as it arrives finds itself cooperating with at least two parallel and adjacent rollers which have the function of calendering the leading end of the strip.

The assembly of wrapper rollers is mounted on a trolley and can assume a non-operative position wherein the rollers open and do not come into contact with the rolled stock being coiled.

The non-operative position is assumed at least when the mandrel is passing from its first to its second operating position to complete coiling.

In its second operating position the mandrel cooperates with at least two movable assemblies from a working position to a non-working position.

To be more exact, according to the invention, there is at least an assembly to support the mandrel, which intervenes to support the shaft of the mandrel when the coil begins to have a considerable weight, and at least an assembly to support the coil equipped with rollers which are positioned from below into peripheral contact with the coil and facilitate coiling.

According to a variant, the assembly to support the mandrel operates according to the vectorial sum of the components of the weight and the drawing action.

According to a further variant, there are other movable assemblies equipped with rollers which, in the working position, come into contact with the coil to facilitate coiling and make it regular and uniform; they also prevent the trailing end of the strip, once the strip has been sheared and the coil is in the braking step, from knocking against the equipment and causing damage, and even from unwinding from the coil.

All these assemblies are movable, axially and/or rotationally, to move into a position of non-contact during the movements of the turntable assembly from its first to its second operating position and vice versa or in the position of exclusion.

BRIEF DESCRIPTION OF THE DRAWINGS

The attached Figures are given as a non-restrictive example and show a preferential embodiment of the invention as follows.

DESCRIPTION OF A PREFERRED EMBODIMENT OF THE INVENTION

Figure 1:
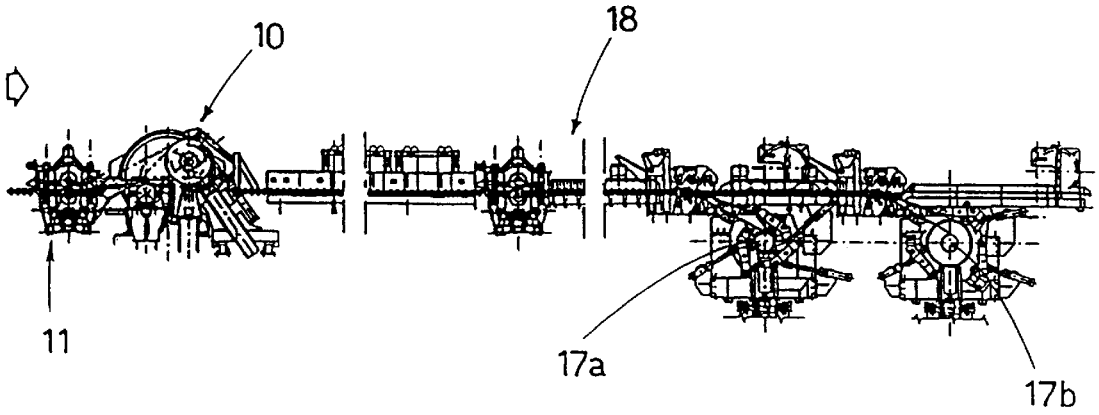
FIG. 1 shows the end portion of a rolling line in which the coiling machine according to the invention is installed.

In the attached Figures, the coiling machine 10 according to the invention is installed at the outlet of a hot rolling train

100 for strip or sheet (not shown here), travelling at speeds of up to 20–22 metres per second, suitable to produce thin rolled stock, from 0.5 to 5 mm, but versatile and adaptable, as will be described later, so as to process rolled stock with a thickness of more than 5 mm.

Upstream of the coiling machine 10 there is a shears assembly 11 provided with two drawing assemblies 19*a* and 19*b*, one located upstream and one downstream of the shearing elements 11*a* and 11*b*, suitable to shear the rolled stock when a coil has been completely formed.

The shears assembly 11 has a substantially U-shaped bearing structure 47, on the vertical arms 47*a* and 47*b* of which the two drawing assemblies 19*a* and 19*b* are mounted. Between the arms 47*a* and 47*b* there is a capsule 48 on which two blade-bearing shafts 49*a* and 49*b* are mounted in a rotary manner.

The capsule 48 can be selectively removed from the bearing structure 47, either with an upwards movement, or by means of a displacement in an axial direction, parallel to the axes of the shafts 49*a* and 49*b*.

Figure 7:
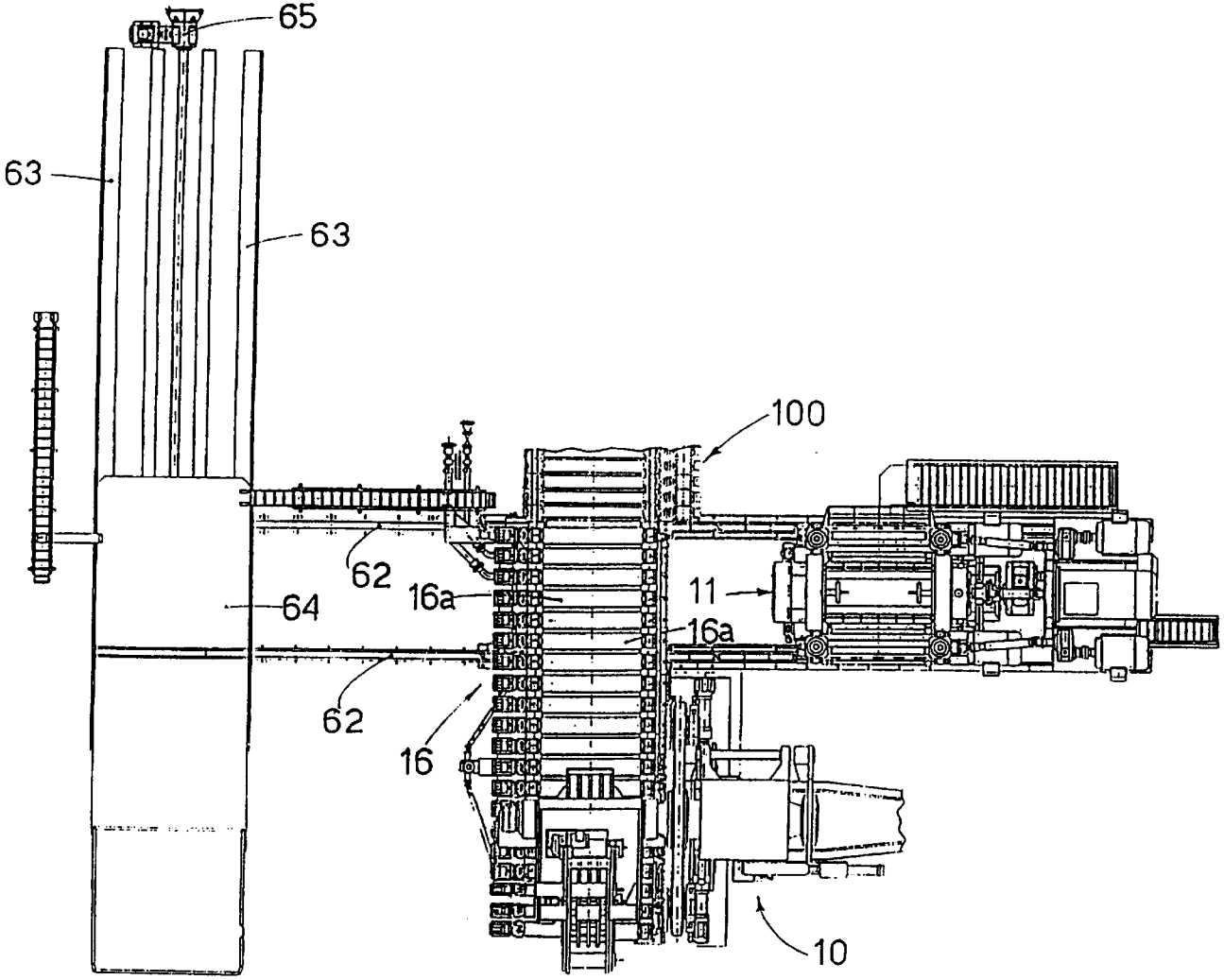
FIG. 7 is a plane view of the rolling line shown in FIG. 6 in a second working lay-out.
Figure 8:
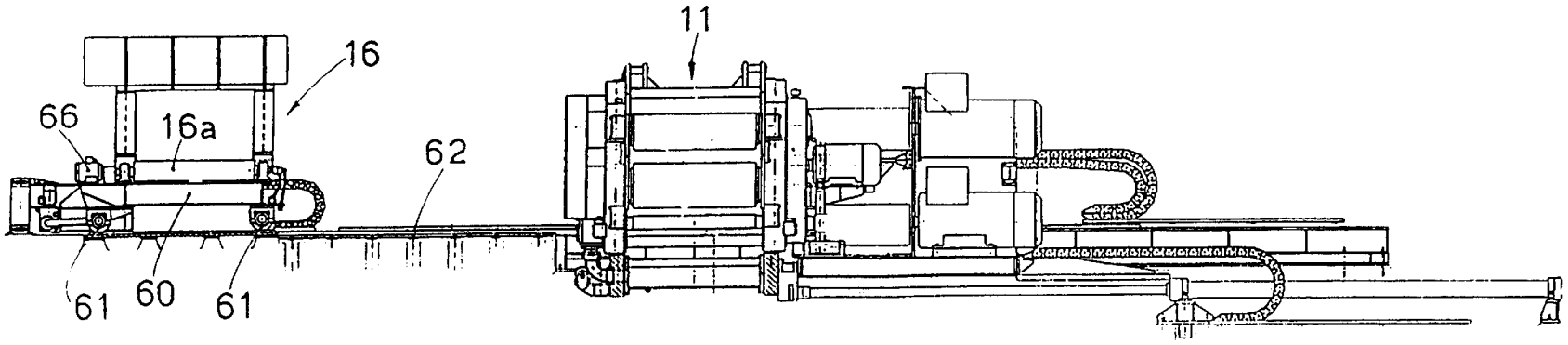
FIG. 8 is a transverse view of the rolling line in its first working lay-out.
Figure 9:
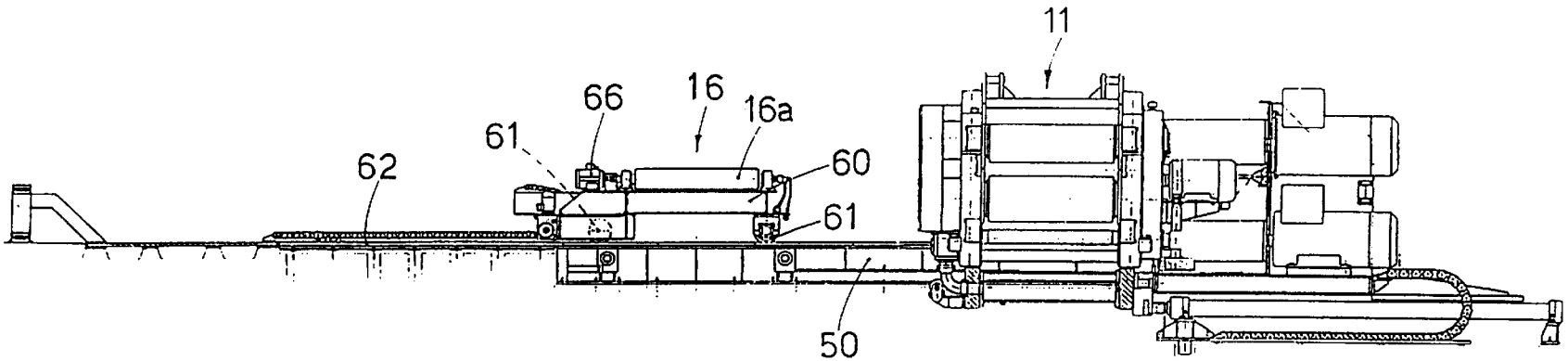
FIG. 9 is a transverse view of the rolling line in its second working lay-out.

The whole shears assembly 11 can also be selectively displaced from its working position as shown in FIGS. 1–6 and 8 to an inactive position as shown in FIGS. 7 and 9.

In fact, the bearing structure 47 is assembled on a pair of rails 50 and can be displaced along an axis orthogonal to the axis of the rolling line.

The coiling machine 10 (FIGS. 1–4) comprises a turntable assembly 12 rotating around an axis 13 which lies on a plane substantially parallel to the plane of feed 14 of the rolled stock, strip or sheet to be coiled and is substantially orthogonal to the axis of feed of the rolled stock to be worked.

The turntable assembly 12 supports two mandrels, respectively 15*a* and 15*b*, arranged diametrically opposite each other and each of which rotates on an axis substantially parallel to the axis of rotation 13 of the turntable assembly 12.

By rotating around the axis 13 the turntable assembly 12 allows the mandrels 15*a* and 15*b* to assume at least three positions.

Figure 2:
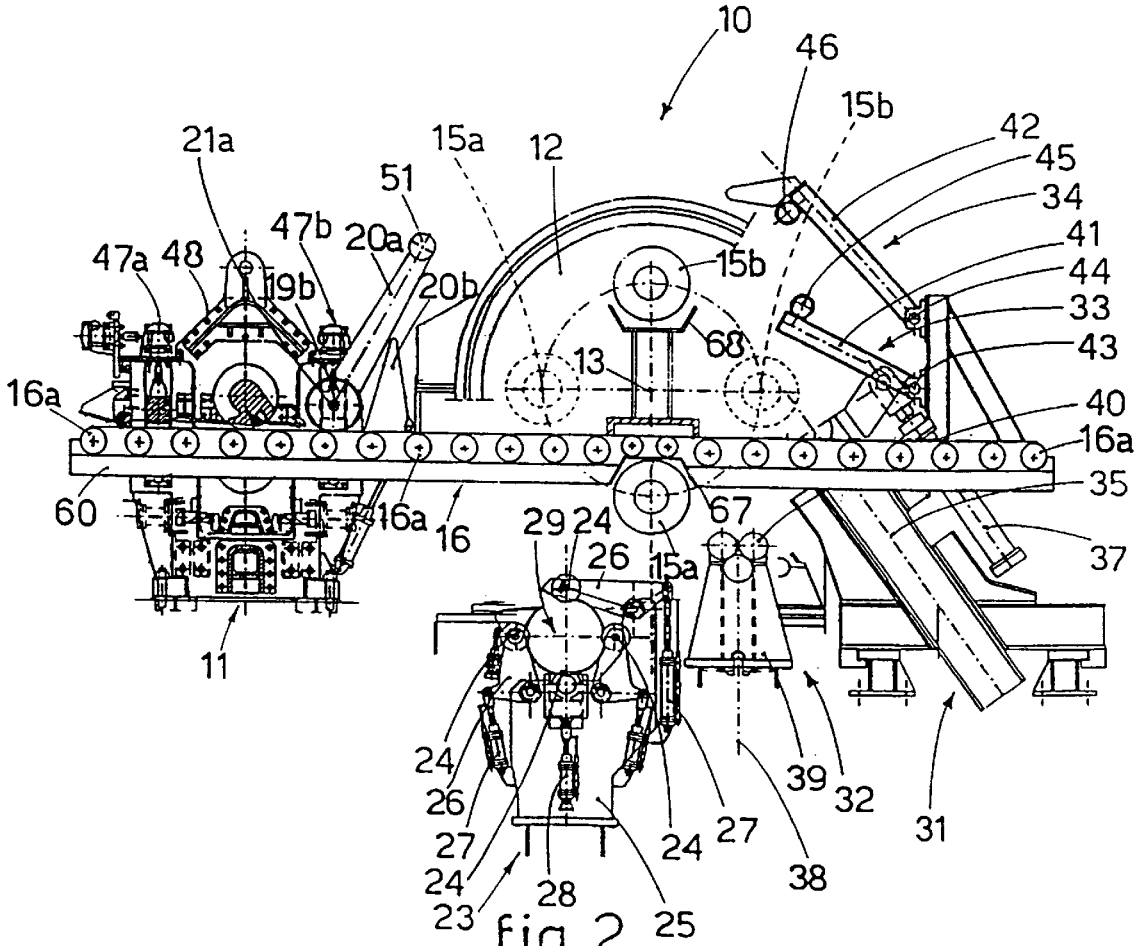
FIG. 2 shows the coiling machine according to the invention with the turntable assembly in the inoperative or exclusion position.

In a non-operative position, shown in FIG. 2, the turntable 12 has both the mandrels 15*a* and 15*b* not in contact with the plane of feed 14 of the rolled stock. To be more exact, the mandrels 15*a* and 15*b* may be arranged either with their axes on a single horizontal plane, and therefore both are above the plane 14, or with their axes on a single vertical plane, and therefore one of the mandrels 15*a* is arranged above the plane 14 and the other mandrel 15*b* is arranged below the plane 14.

This non-operative position is assumed when the coiling machine 10 is in a position of exclusion from the line, for example when the rolled stock is of a thickness greater than 5 mm, and therefore it cannot be coiled by the coiling machine 10.

A rollerway 16 of the retractable type is suitable to cooperate selectively with the coiling machine 10 (FIGS. 2 and 6–9). The rollerway 16 comprises a plurality of rollers 16*a* assembled in a rotary manner on the lateral supports of a substantially horizontal bench 60, which can slide by means of wheels 61 on a lower track defined by a pair of rails 62, parallel and adjacent to the rails 50.

The bench 60 can also slide by means of a slider 64 on a second pair of rails 63 arranged parallel to the rolling line and therefore orthogonal to the rails 62. There is also on the bench 60 a pair of protective screens 67 and 68 which, when the turntable 12 is in its inactive or exclusion position, are suitable to arrange themselves thus: the first between the first rollers 16*a* and the mandrel 15*a* which is below the rollerway 16; and the second between the rollers 16*a* and the mandrel 15*b* which is above the rollerway 16. The protective screens 67 and 68 thus prevent the heat irradiated by the rolled stock passing over the rollers 16*a* from reaching and damaging the mandrels 15*a* and 15*b*, which during this step of the working cycle are stationary and not cooled.

When rolled stock with a thickness of between 0.5 and 5 mm is being worked, the bench 60 and the relative rollerway 16 are positioned in an inactive position (FIGS. 6 and 8), remote from and behind the coiling machine 10.

However, when rolled stock with a thickness of more than 5 mm is being worked, the bench 60 and the relative rollerway 16 are taken to the working position as shown in FIGS. 2, 7 and 9, by means of motors 65 and 66.

In this operating position, the rollerway 16 comes into cooperation with the plane of feed 14 so as to accompany the rolled stock towards conventional coiling devices arranged downstream, for example downcoilers 17*a* and 17*b* (FIG. 1), after the rolled stock has passed through the cooling zone 18.

Figure 3:
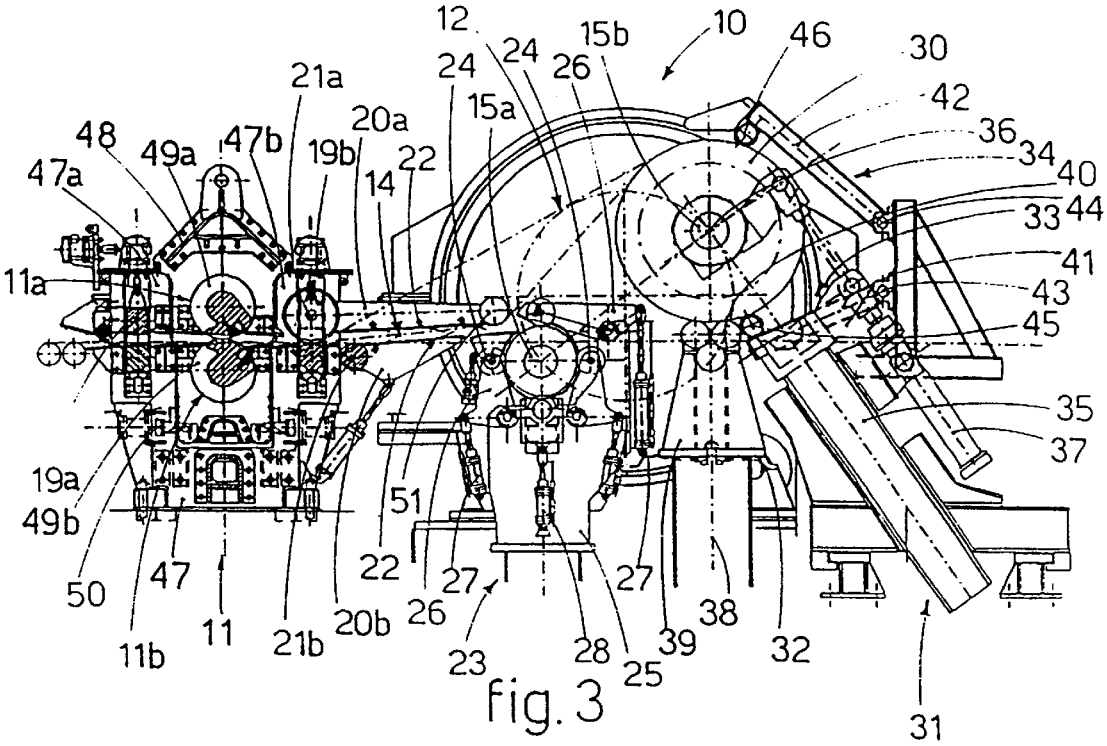
FIG. 3 shows the coiling machine according to the invention with the turntable assembly in the first operating position.
Figure 4:
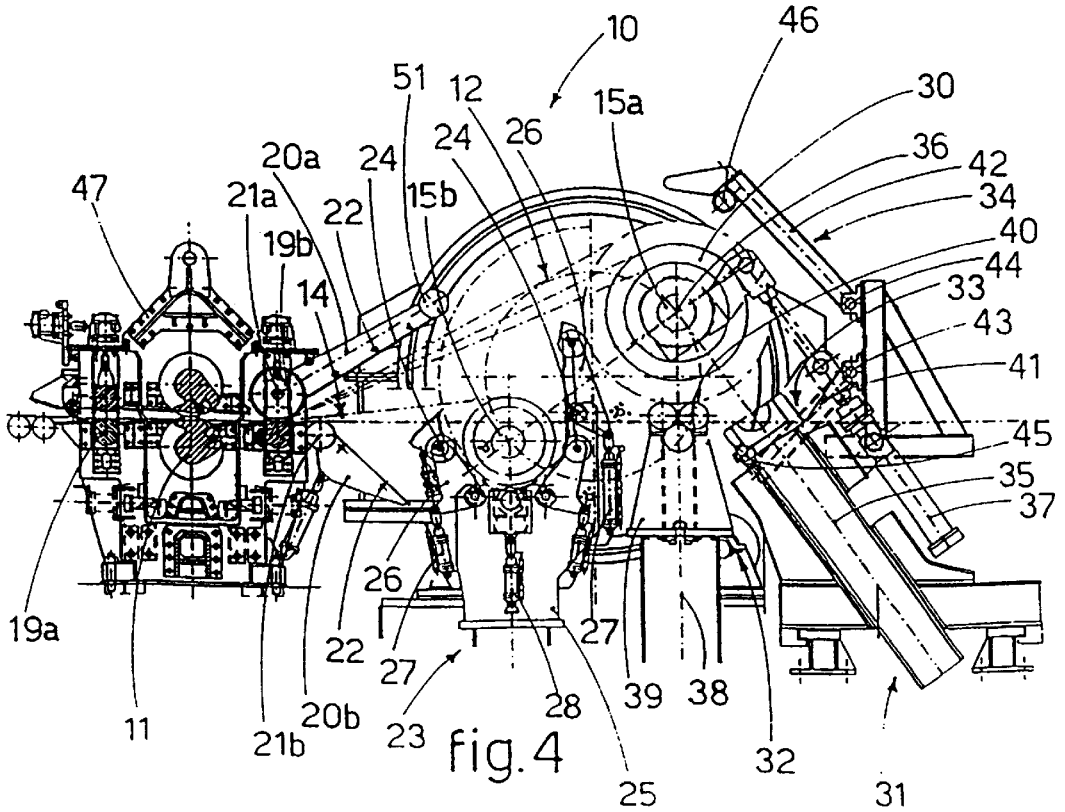
FIG. 4 shows the coiling machine according to the invention with the turntable assembly in its second operating position.

However, when the thickness of the rolled stock is compatible with the coiling machine 10, for example between 0.5 and 5 mm, the turntable assembly 12 arranges the two mandrels 15*a* and 15*b* in one or another of the two operating positions shown in FIGS. 3 and 4 in order to coil the strip.

In each of the two operating positions, the plane passing through the axes of rotation of the two mandrels 15*a* and 15*b* is substantially at an angle of 45° with respect to the vertical plane which the axes of rotation of the mandrels were on when the turntable 12 was in the inoperative or exclusion position as shown in FIG. 2.

In the first operating position (FIG. 3), the first mandrel 15*a* is arranged substantially in cooperation with the plane of feed 14 while the second mandrel 15*b* is in a raised position and remote from the plane of feed 14.

On the contrary, in the second operating position (FIG. 4), rotated by 180° with respect to the first position, the mandrel 15*a* onto which the coil of rolled stock is already being wound finds itself in the position in which the corresponding mandrel 15*b* was before, while the latter finds itself in the position where the mandrel 15*a* was before, ready to receive a new leading end of rolled stock.

At the outlet of the shears assembly 11 the drawing assembly 19*b* accompanies the leading end of the rolled stock towards the first mandrel 15*a*, making it pass through two movable guide blades, respectively upper 20*a* and lower 20*b*.

The movable guide blades 20*a* and 20*b* are arranged opposite each other with respect to the plane of feed 14 and are articulated, oscillating in respective fulcrums 21*a* and 21*b* in the vertical arm 47*b* of the shears assembly 11 to assume a first position of non-contact (FIG. 4) distant from the plane of feed 14 and a second working position (FIGS. 3 and 5) in direct cooperation with the plane of feed 14. The movable guide blades 20*a* and 20*b* are also suitable to be distanced from the plane of feed 14, together with the shears assembly 11 on which they are mounted, so as not to interfere with the rollerway 16 and the relative bench 60.

The surface of the movable guide blades 20*a* and 20*b* have slits 22 to emit a jet of fluid, preferentially air or air mixed with oil or another liquid, which acts as a pneumatic, hydraulic or mixed pneumatic-hydraulic support for the rolled stock in the segment between the shears assembly 11 and the turntable assembly 12.

Thanks to this pneumatic, hydraulic or mixed pneumatic-hydraulic support, it is possible to guide the leading end of the strip without it bending or turning over or rubbing, and in any case ensuring that the rolled stock is guided.

The upper guide blade 20*a* is provided with a sliding roller 51 at the end and at least an intermediate position between the first position of non-interference and the second, working position. In this intermediate position, the upper guide blade 20*a* accompanies the rolled stock during the end-of-coiling step when the turntable 12 is in the second operating position.

Figure 5:
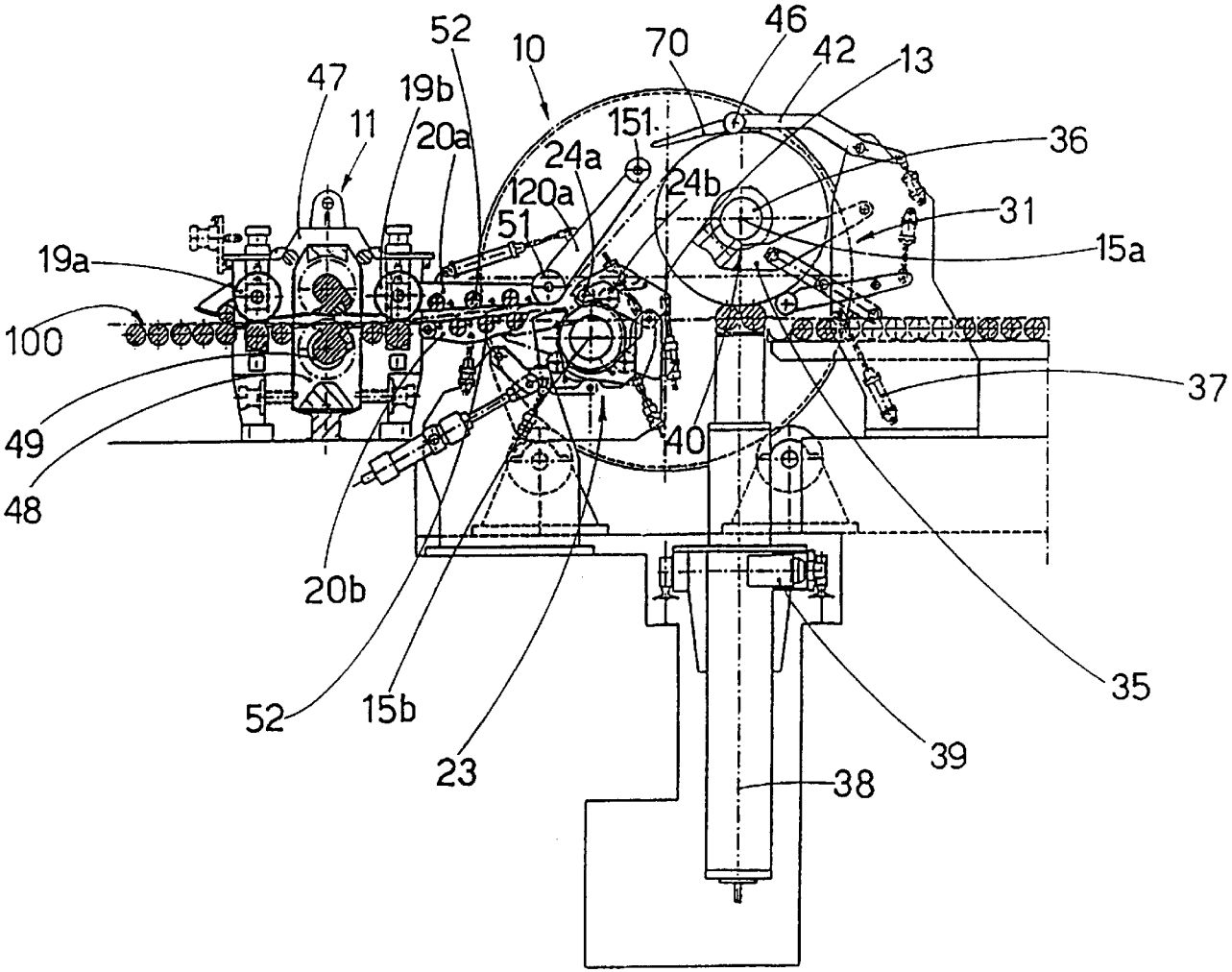
FIG. 5 shows a variant of the previous embodiments.
Figure 6:
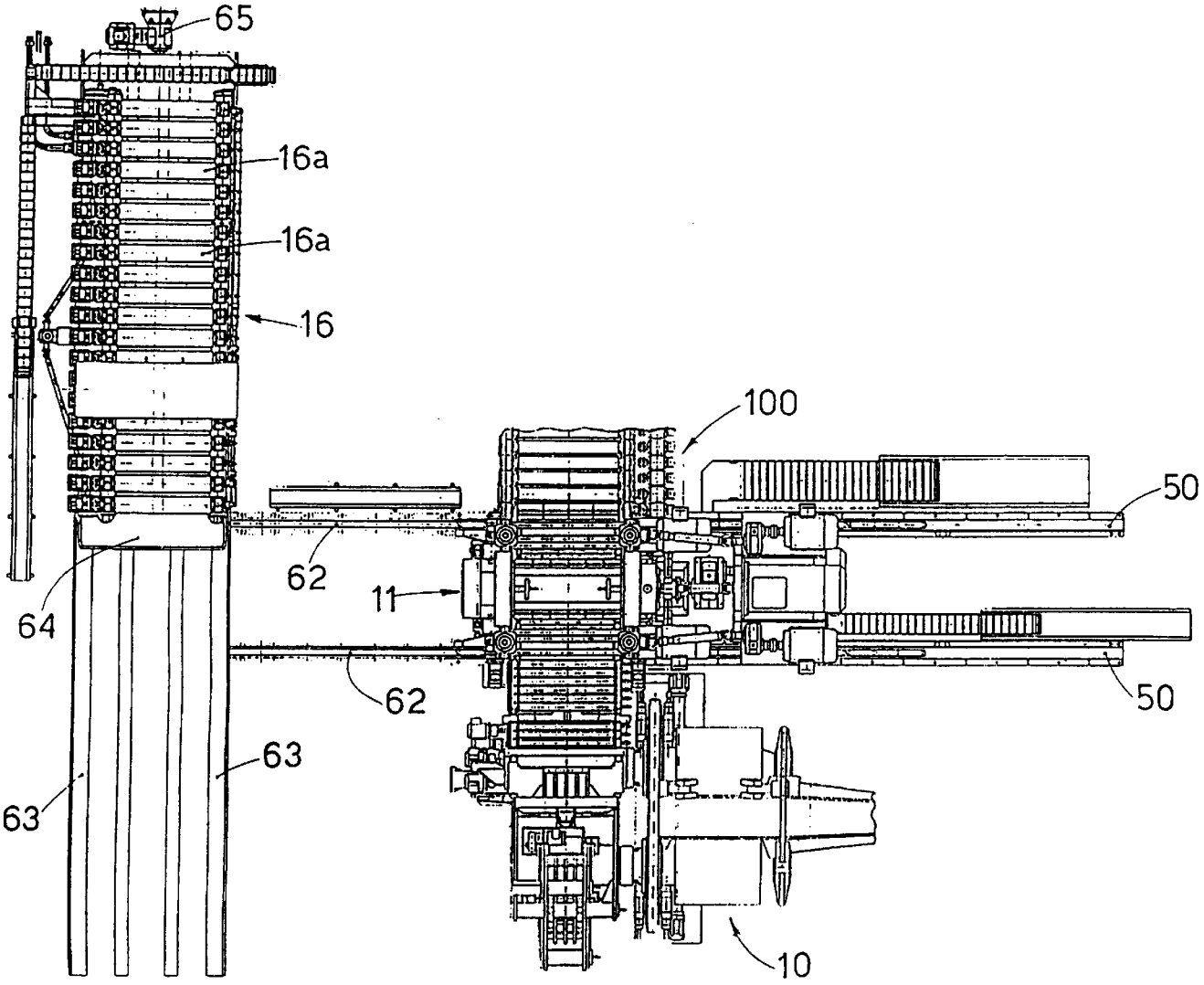
FIG. 6 is a plane view of a rolling line where the coiling machine according to the invention is installed, in a first working lay-out.

In the variant shown in FIG. 5, the slits 22 to emit the jet of fluid are included on both the movable guide blades 20*a* and 20*b*, and associated with the slits 22 there are driven rollers 52, rotating at a peripheral speed greater than the speed of feed of the rolled stock, thus preventing blockages from taking place.

Again in FIG. 5, the upper guide blade 20*a* is associated, in correspondence with the sliding roller 51, with a second upper guide blade 120*a* which is rotatable on the first blade 20*a* and which is also provided at the end with a sliding roller 151, which serves to control and guide the rolled stock and to contain the trailing end during the braking step of the coil.

The second upper guide blade 120*a* may also include slits 22 for jets of fluid.

During the start-of-coiling step on the first mandrel 15*a*, or on the mandrel which on each occasion finds itself in the position of cooperation with the plane of feed 14 (FIG. 3), an assembly 23 of wrapper rollers 24, mounted on a trolley 25 is taken from a position of exclusion (FIG. 2) to a working position cooperating with the first mandrel 15*a* to accompany and guide the leading end of the rolled stock around the first mandrel 15*a* and begin coiling.

The assembly 23 comprises, in this case, a series of four rollers 24 cooperating with three or four circumferential positions of the mandrel 15*a*, each of the rollers 24 being mounted on a respective articulated arm 26 associated with a relative actuator 27.

When it is desired to take the assembly 23 from the position of exclusion as shown in FIG. 2 to the working position as shown in FIG. 3, the rollers 24 are opened by activating the actuators 27, then the trolley 25 is raised to bring it nearer the plane of feed 14 and then an actuator 28 is activated to complete the insertion of the rollers 24 in correspondence with the mandrel 15*a*, so that the latter arranges itself inside the circumferential profile 29 of the assembly 23.

Then the rollers 24 are again closed around the mandrel 15*a* oscillating the articulated arms 26 around their respective fulcrums by means of activating the actuators 27.

During the pick-up step, the invention provides to perform a calendering action on the leading end of the rolled stock (FIG. 5) and for this reason two paired rollers 24*a*, 24*b* are included which, when the leading end of the rolled stock arrives, carry out a pre-bending operation thereon.

Then the controlled coiling of the rolled stock around the mandrel 15*a* is begun.

When the desired number of spirals has been coiled onto the first mandrel 15*a*, the turntable assembly 12 is rotated by 180° into its second operating position (FIG. 4) to carry the first mandrel 15*a* into the position wherein coiling is completed and the coil is consequently discharged, while the second mandrel 15*b* is taken to the waiting and start-of-coiling position which had previously been occupied by the first mandrel 15*a*.

Before the turntable assembly 12 is rotated, the wrapper rollers 24 are opened.

While the turntable assembly 12 is rotated, the first mandrel 15*a* continues to rotate and to wind onto itself the rolled stock until it stops its positioning in the position shown in FIG. 4.

Coiling continues until the coil 30 being formed reaches a certain weight, at which point the respective support assemblies 31 and 32, arranged below the mandrel 15*a*, intervene to support the mandrel 15*a* and the coil 30; also at this point, assemblies 33 and 34 to make the coiling regular and uniform, arranged peripherally to the mandrel 15*a*, also intervene.

The assembly to support the mandrel 31 comprises at least an arm 35, axially movable from a position of non-contact, far from the turntable 12, to a position wherein it cooperates with the shaft 36 of the mandrel 15*a*.

The arm 35, for example equipped at the end with fork elements, hand means, saddle-type supports or whatever is suitable for the purpose, extends towards the mandrel 15*a*, driven by an actuator 37, and gives support to the shaft 36 of the mandrel 15*a* according to the steadily increasing weight of the coil 30 as it forms.

According to a variant shown in FIG. 5, the arm 35 is rotary and includes at the terminal end a support suitable to support the shaft 36 of the mandrel 15*a*.

This support occurs around the component of the drawing force and the weight force.

The assembly to support the coil 32 comprises a movable trolley 39 which can be raised according to an axis 38. Above the assembly to support the coil 32 there are rollers 40 to support the coil 30 from below; the rollers 40, in their working position, are positioned in contact with the coil 30 and support it from below.

The assemblies 33 and 34 to make coiling regular and uniform comprise respective arms 41 and 42, oscillating around respective fulcrums 43 and 44 to move from a position of non-contact (FIGS. 2 and 4) to a working position cooperating with the coil 30 as it is formed.

At the end of the arms 41 and 42 there are respective rollers 45 and 46 which, as the coil 30 is being formed, are arranged at a distance of about ten millimetres from the periphery of the coil 30, so as not to interfere as it forms, ready to come into contact with the coiled rolled stock in order to perform a braking action and to prevent a possible collapse or unwinding of the coil 30 when the latter is being completed.

According to the variant shown in FIG. 5, the arm 42 is provided with a guide appendix 70 which extends beyond the roller 46 to prevent, in collaboration with the guide 120*a*, the trailing end of the rolled stock from knocking uncontrollably against the upper part of the turntable 12 before the coil 30, just completed, is removed from the mandrel 15*a*. The assembly to support the coil 32 and the assemblies 33 and 34 to make the coiling regular and uniform are displaced, during the coiling step, in coordination with the increase in thickness of the coil 30 as it forms.

When the coil 30 has been completed, the shears assembly 11 located upstream of the coiling machine 10 shears the rolled stock, defining the leading end of the new coil which begins to be coiled onto the second mandrel 15*b*, after the assembly 23 of wrapper rollers 24 has been taken back to the position of cooperation with the mandrel 15*b*, just as it had previously done with the mandrel 15*a*.

The assembly to support the mandrel 31, the assembly to support the coil 32 and the assemblies 33 and 34 to make coiling regular and uniform cooperating with the first mandrel 15*a* are partly opened so as to allow the formed coil 30 to be discharged; this is done with ways and means known to the art.

The coiling cycle can thus be repeated in the above-described manner.

What is claimed is:

1. A shearing and coiling assembly for hot rolled stock such as strip or sheet with a thickness varying from 0.5 to more than 5 mm, comprising:

a rolling train (100) which defines a substantially horizontal plane of feed (14), a shearing assembly (11) suitable to shear selectively the rolled stock and a coiling machine arranged downstream from the shearing assembly (11) to selectively wind the stock sheared by the shearing assembly (11), wherein the coiling machine (10) comprises a turntable assembly (12) rotating around a central axis of rotation (13) parallel to the plane of feed (14) and two coiling mandrels (15*a*, 15*b*) mounted rotary on the turntable (12) on diametrically opposite sides with respect to the central axis of rotation (13) and with their axes of rotation parallel to the central axis of rotation (13), the shearing assembly (11) is mounted sliding on first guide means (50) arranged transverse to the plane of feed (14) and is selectively movable between a first working position, in which the shearing assembly (11) is aligned with the plane of feed (14), and a second inactive position, in which the shearing assembly (11) is distanced from the plane of feed (14), a rollerway (16), arranged on a substantially horizontal plane, is mounted sliding on second guide means (62) arranged transverse to the plane of feed (14) and is selectively movable between a first working position, in which the rollerway (16) is aligned with the plane of feed (14), and a second inactive position, in which the rollerway (16) is distanced from the plane of feed (14), when the shearing assembly (11) is in the first working position, the rollerway (16) is in the second inactive position and vice versa, and the coiling machine (10) is suitable to assume an inactive position when the shearing unit (11) is in the second inactive position and the rollerway (16) is in the first working position.

2. The shearing and coiling assembly as in claim 1, wherein the shearing assembly (11) comprises a U-shaped bearing structure (47), on which is mounted a capsule (48) to support a pair of blade-bearing shafts (11*a*, 11*b*), the capsule (48) being able to be selectively removed from the bearing structure (47).

3. The shearing and coiling assembly as in claim 1, wherein the first guide means comprise at least a horizontal rail (50), the second guide means comprise at least a horizontal rail (62), and these rails are arranged orthogonal to the plane of feed (14).

4. The shearing and coiling assembly as in claim 1, wherein the rollerway (16) comprises a substantially horizontal supporting bench (60) on which a plurality of rollers (16*a*) are mounted rotary and the turntable (12) is suitable to be arranged in an angled inactive position, with a first mandrel (15*a*) arranged below the rollers (16*a*) and a second mandrel (15*b*) arranged above the rollers (16*a*), means of protection against heat (67, 68) being mounted on the bench (60) to be arranged between the mandrels (15*a*, 15*b*) and the rollers (16*a*) when the rollerway (16) is in the first working position.

5. The shearing and coiling assembly as in claim 1, wherein an assembly (23) to guide the strip is suitable to cooperate selectively with each of the mandrels (15*a*, 15*b*), the turntable assembly (12) being able to assume, by rotating, a first angled position wherein a first mandrel (15*a* or 15*b*) is in correspondence with the plane of feed (14) and ready to receive the leading end of the rolled stock and to begin coiling, wherein the assembly (23) to guide the strip is normally arranged in a first inactive position outside the turntable assembly (12) and is selectively movable to a second working position, associated with the first angled working position of the turntable (12), in which the assembly (23) to guide the strip is suitable to cooperate with the leading end of the rolled stock to guide the leading end of the rolled stock around the first mandrel (15*a* or 15*b*).

6. The shearing and coiling assembly as in claim 1, wherein each of the mandrels (15*a*, 15*b*) is provided with its own rotation shaft (36), wherein at least an assembly to support the mandrel (31) is provided to cooperate with the rotation shaft (36) of the mandrel which is in the position wherein the coil (30) is completed and discharged from the mandrel (15*a*, 15*b*), the assembly to support the mandrel (31) being movable from an inactive position and a working position wherein it cooperates with the shaft of the mandrel (36).

7. The shearing and coiling assembly as in claim 1, wherein at least an assembly (33, 34) to make coiling regular and uniform is provided to cooperate with the periphery of the coil (30) being formed in the position wherein the coil (30) is completely coiled and ready to be discharged from the mandrel (15*a*, 15*b*), the assembly (33, 34) to make coiling regular and uniform being movable and including a first inactive position and a second position associated with the periphery of the coil (30) being formed.

8. The shearing and coiling assembly as in claim 2, wherein the bearing structure (47) is provided with vertical arms (47*a*, 47*b*) on each of which there is mounted a corresponding drawing assembly (19*a*, 19*b*) for the rolled stock.

9. The shearing and coiling assembly as in claim 2, wherein at least a first guide blade (20*a*) is hinged on the bearing structure (47) to guide the rolled stock towards the mandrels (15*a*, 15*b*).

10. The shearing and coiling assembly as in claim 9, wherein the guide blade (20*a*) is movable between a first exclusion position arranged distant from the plane of feed (14), a second working position cooperating with the plane of feed (14) and a third position to grip the rolled stock in the transitory segment between the two positions.

11. The shearing and coiling assembly as in claim 9, wherein the guide blade (20*a*) is provided with means (22) to emit at least a jet of air or liquid for the rolled stock.

12. The shearing and coiling assembly as in claim 10, wherein a second guide blade (20*b*) is associated with the first guide blade (20*a*) and is also hinged on the bearing structure (47) to guide the rolled stock towards the mandrels (15*a*, 15*b*).

13. The shearing and coiling assembly as in claim 12, wherein the two guide blades (20*a*, 20*b*) cooperate respectively from above and from below with the plane of feed (14).

14. The shearing and coiling assembly as in claim 11, wherein the guide blade (20*a*) is provided with driven rollers (52) suitable to rotate at a peripheral speed greater than that of the speed of feed of the rolled stock.

15. The shearing and coiling assembly as in claim 11, wherein the guide blade (20*a*) is connected with another, upper guide blade (120*a*) suitable to guide the rolled stock being coiled on the mandrels (15*a*, 15*b*).

16. The shearing and coiling assembly as in claim 5, wherein the turntable assembly (12) is suitable to assume, by rotating, a second angled working position, rotated by 180° with respect to the first angled working position, in which a second mandrel (15*b* or 15*a*) is in correspondence with the plane of feed (14) ready to receive the leading end of the rolled stock and to begin coiling, while the first mandrel (15*a* or 15*b*) is at the same time in a position wherein the coil (30) is completely coiled and ready to be discharged, the assembly to guide the strip (23) being suitable to assume the inactive position during the rotation of the turntable assembly (12) from the first to the second angled working position and vice versa.

17. The shearing and coiling assembly as in claim 5, wherein the assembly to guide the strip (23) comprises a plurality of wrapper rollers (24) having their axes of rotation parallel to the central axis of rotation (13) and arranged along an ideal circumference beyond the area occupied by each of the mandrels (15*a*, 15*b*) to define a circular guide path for the leading end of the rolled stock around the mandrel which is temporarily in correspondence with the plane of feed (14).

18. The shearing and coiling assembly as in claim 17, wherein there are at least three wrapper rollers (24) which have their axes arranged substantially at constant angled distances along the ideal circumference, and at least one of the wrapper rollers (24) is movable to be selectively distanced from the ideal circumference to allow the corresponding mandrel (15*a*, 15*b*) to be arranged between the three wrapper rollers (24).

19. The shearing and coiling assembly as in claim 17, wherein the wrapper rollers (24) are mounted on corresponding oscillating arms (26) connected to actuators (27) suitable to take the wrapper rollers (24) selectively far from the position of cooperation with the periphery of the respective mandrel (15*a*, 15*b*).

20. The shearing and coiling assembly as in claim 6, wherein the assembly to support the mandrel (31) comprises an arm (35) movable axially and comprising at the end support elements to support the shaft (36) of the mandrel selected from the group consisting of fork-shaped elements, hand-shaped elements and saddle-shaped elements.

21. The shearing and coiling assembly as in claim 20, wherein at least a coil support assembly (32) is provided to cooperate from below with the coil (30) being formed in the position wherein the coil (30) is completely coiled and ready to be discharged from the mandrel (15*a*, 15*b*), the coil support assembly (32) being movable and including a first inactive position and a second position of cooperation with the coil (30).

22. The shearing and coiling assembly as in claim 21, wherein the coil support assembly (32) comprises a pair of rollers (40) associated with a movable trolley (39) and with a lifting actuator.

23. The shearing and coiling assembly as in claim 7, wherein the assembly (33, 34) to make coiling regular and uniform comprises an oscillating arm (42) with a roller (46) at the end.

24. The shearing and coiling assembly as in claim 23, wherein the oscillating arm (42) is provided with an appendix (70) suitable to cooperate with the trailing end of the rolled stock when the coil (30) is in its completion step to prevent the trailing end from knocking against the parts of the coiling machine (10).

* * * * *

UNITED STATES PATENT AND TRADEMARK OFFICE

CERTIFICATE OF CORRECTION

PATENT NO. : 6,220,070 B1
DATED : April 24, 2001
INVENTOR(S) : Fausto Drigani, Giacinto Dal Pan, and Cesare Galletti It is certified that error appears in the above-identified patent and that said Letters Patent is hereby corrected as shown below:

The name of the Assignee is DANIELI & C. OFFICINE MECCANICHE S.p.A.

Signed and Sealed this

Sixteenth Day of April, 2002

*Attest:*

*Attesting Officer*

JAMES E. ROGAN
*Director of the United States Patent and Trademark Office*

Disclaimer 6,220,070—Fausto Drigani, Pozzuolo del Friuli; Giacinto Dal Pan, Cellatica; Cesare Gallptti, Segrate S. Felice, all of (IT). SHEARING AND COILING ASSEMBLY FOR HOT ROLLED STOCK. Patent dated April 24, 2001. Disclaimer filed on October 2, 2002, by the Assignee, Danieli & C. Officine Meccaniche S.p.A.

The term of this patent shall not extend beyond the expiration date of Patent Nos. 6,332,588 and 6,502,445.

*(Official Gazette, July 22, 2003)*